United States Patent [19]

Bradshaw et al.

[11] 4,365,608

[45] Dec. 28, 1982

[54] CONTROLLING ENGINE EXHAUST GAS RECIRCULATION AND VACUUM INVERTER

[75] Inventors: Cyril E. Bradshaw, Kalamazoo; Martin W. Uitvlugt, Battle Creek, both of Mich.

[73] Assignee: Eaton Corporation, Cleveland, Ohio

[21] Appl. No.: 185,467

[22] Filed: Sep. 9, 1980

[51] Int. Cl.[3] ..... F02M 25/06

[52] U.S. Cl. ..... 123/568; 123/408; 137/102; 137/103; 137/DIG. 8

[58] Field of Search ..... 137/DIG. 8, 103, 102, 137/116.3; 123/568, 408, 571

[56] References Cited

U.S. PATENT DOCUMENTS

| | | | |
|---|---|---|---|
| 3,762,384 | 10/1973 | Day et al. | 123/568 |
| 3,799,131 | 3/1973 | Bolton | 123/568 |
| 3,880,129 | 4/1975 | Hollis, Jr. | 123/568 |
| 3,982,553 | 9/1976 | Johnston et al. | 137/103 |
| 3,982,555 | 9/1976 | Aubel et al. | 137/103 |
| 4,116,182 | 9/1978 | Bradshaw | 123/568 |
| 4,166,476 | 9/1979 | Yamanaka et al. | 137/103 |
| 4,173,204 | 11/1979 | Takayama et al. | 123/568 |
| 4,334,515 | 6/1982 | Otsuka | 123/568 |

FOREIGN PATENT DOCUMENTS

| | | | |
|---|---|---|---|
| 52-61649 | 5/1977 | Japan | 123/408 |
| 918824 | 2/1963 | United Kingdom | 123/102 |

*Primary Examiner*—Wendell E. Burns
*Attorney, Agent, or Firm*—C. H. Grace; F. M. Sajovec

[57] ABSTRACT

Engine manifold vacuum is inverted by an in-line vacuum inverter which provides a power source for an EGR valve actuator for providing desired EGR flow in a predetermined range of engine power loading and EGR flow is cut off outside the range. The invention utilizes a vacuum inverter employing a pair of spaced diaphragms for controlling an atmospheric air bleed valve to a vacuum chamber powered by manifold vacuum. The diaphragms are spring loaded so as to seek equilibrium positions as vacuum in the chamber varies force. The inverter produces a vacuum output signal which changes inversely with changes in engine manifold vacuum.

17 Claims, 6 Drawing Figures

CONTROLLING ENGINE EXHAUST GAS RECIRCULATION AND VACUUM INVERTER

BACKGROUND OF INVENTION

The present invention relates to the control of exhaust gas recirculation (EGR) in internal combustion engines for motor vehicle use. In automotive engine applications, fluid pressure actuated controllers have been employed for moving a valve member, or pintle, for controlling flow of exhaust gas through a passage interconnecting the combustion chamber of exhaust and intake passages in the engine. Such fluid pressure valve controllers are often provided with a diaphragm actuator having a rod connected from the diaphragm to the pintle to move the pintle in response to a fluid pressure signal. A signal is provided to the diaphragm actuator indicative of varying engine load conditions. A convenient source of such a signal is ported or raw engine manifold vacuum, exhaust backpressure or a combination of manifold vacuum and exhaust gas backpressure. It is also known to combine engine inlet manifold vacuum and throttle venturi suction signals to provide a control signal for operating the exhaust gas recirculation valve or pintle.

Known examples of EGR controllers employing a combination of engine manifold vacuum and exhaust backpressure are the devices described in U.S. Pat. Nos. 4,116,182, 3,799,131 and 3,762,384. The '182 patent utilizes a device employing a combination of exhaust gas backpressure and manifold vacuum to provide a variable percentage of EGR; whereas, the '131 and '384 patents employ a combination of manifold vacuum and exhaust backpressure to provide a generally constant percentage of EGR. Another EGR controller employing ported manifold vacuum in combination with exhaust backpressure to control EGR is shown and described in U.S. Pat. No. 3,880,129.

Another known EGR valve controller is that known in the art as the sonic controller, which employs complex electromechanical sensors and actuators for moving an EGR valve pintle so as to maintain sonic flow at the valve seat, whereby the flow is independent of pressure variations downstream of the pintle. Such a sonic type EGR valve controller provides desired control of EGR; however, the electromechanical sensors and control systems required to sense the pintle position and move the pintle for maintaining sonic flow across the valve seat have been quite costly and difficult to manufacture for repeatability and reliability. Consequently, EGR controllers operating to maintain sonic flow across the EGR pintle have not found widespread acceptance.

One of the problems encountered in providing the proper amount of EGR for the required reduction in exhaust emissions has been that the EGR valve controllers responding to engine manifold vacuum to provide control of the flow of EGR, have under certain operating conditions caused engine faltering and poor drivability. This problem has been particularly troublesome where the EGR controller, responding to increased engine manifold vacuum caused by throttle closure at high RPM, provided a large dose of EGR. Upon reopening of the throttle faltering and loss of power occurred in the engine.

It is also known to utilize engine manifold vacuum as a fluid pressure power source for the EGR valve actuator and to superimpose thereon the effects of carburetor venturi suction pressure change, which varies inversely as manifold vacuum, to provide control of EGR valve movement. Carburetor venturi suction alone is a low level signal with insufficient power to drive an EGR valve controller. However, combining carburetor venturi suction and manifold vacuum in a single controller results in a complicated mechanism and requires the costly additional hoses and pressure tap at the carburetor venturi. Furthermore, many carburetors in automotive engine applications have variable venturi throat configurations and thus a pressure tap at the venturi throat would not read a pressure directly proportional to engine mass flow.

Engine manifold vacuum is nevertheless a convenient source of fluid pressure which varies in accordance with changes in engine load and speed and is thus desirable as an input signal for an EGR controller. Furthermore, engine manifold vacuum is readily accessible and provides the lowest cost source of an input control signal for an EGR flow control valve. Thus, it has been desirable to provide a means of controlling EGR in an engine utilizing manifold vacuum as the primary control signal and yet to provide a way of preventing overdosage of EGR at engine operating conditions in which the manifold vacuum reaches high levels, but the engine load is such that minimum or no EGR flow is required for reduction of exhaust emissions.

SUMMARY OF THE PRESENT INVENTION

The present invention addresses the above-described problem of providing EGR flow in an engine utilizing exhaust manifold vacuum as a primary control signal source and of providing a way of defeating the EGR flow when the manifold vacuum signal is high, but engine operating load requirements do not dictate EGR flow for exhaust emission reductions. The present invention provides a method of utilizing engine manifold vacuum as a control signal source and providing an output vacuum control signal for operating a fluid pressure responsive actuator or controller for moving an EGR flow control valve member. The method of the present invention provides for the desired percentage of exhaust gas recirculation as a function of engine air flow induction over the range of engine manifold vacuum levels throughout which it is necessary to recirculate exhaust gas for reduction of exhaust emissions. The present invention provides for limiting the EGR flow at engine manifold vacuum levels above a predetermined value so as to prevent loss of engine power or faltering. The present invention employs the technique of inverting changes of manifold vacuum so as to provide a vacuum output signal to the valve actuator, in the desired control range, which varies inversely as the engine manifold vacuum.

The present invention employs a vacuum inverter controller which receives only engine manifold vacuum and requires no auxiliary control signal, such as venturi suction, to provide a variable vacuum output signal which varies inversely as the manifold vacuum input signal. The inverter controller of the present invention provides no output signal at engine manifold vacuum levels below a predetermined minimum input signal level and defeats the output signal at input vacuum signal levels above a predetermined value. The present invention thus provides a unique and simple solution to the problem of providing adequate control of EGR in an internal combustion engine to provide sufficient EGR for exhaust emission reduction, yet prevents overdoses of EGR which result in loss of engine power and/or faltering.

DETAILED DESCRIPTION

Figure 1:
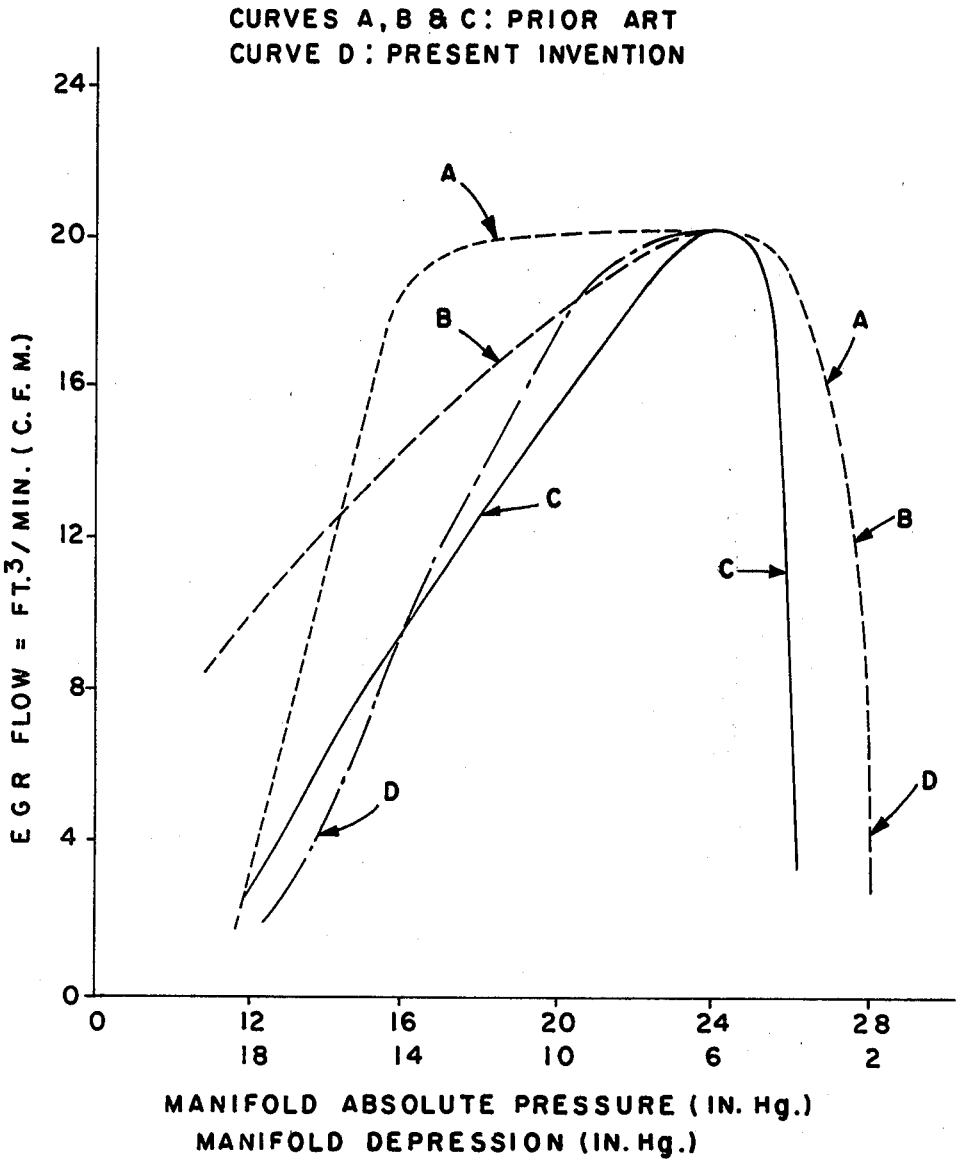
FIG. 1 is a graph of EGR flow plotted as a function of manifold vacuum for the various known prior art systems and the present invention.

Referring to FIG. 1, the graph has been plotted of EGR flow as a function of engine manifold vacuum or manifold absolute pressure (MAP), wherein the curve denoted by the letter "A" represents prior art devices of the type utilizing raw or ported manifold vacuum to operate the diaphragm actuator for moving the EGR valve. Curve "B" in FIG. 1 illustrates the prior art devices of the type employing a combination of manifold vacuum and exhaust gas backpressure to provide a control signal for operating EGR valve pintle. Curve "C" in FIG. 1 illustrates the control provided by a prior art sonic flow device wherein electromechanical sensors and actuators are used to maintain the EGR pintle position to maintain sonic flow at the valve seat. Curve "D" in FIG. 1 represents the EGR flow for the present invention. It will be seen from the curves of FIG. 1 that the present invention most closely approximates the control provided by a sonic EGR controller as compared with other prior art devices.

The curve D representing the present invention in FIG. 1, illustrates the technique of controlling EGR described herein where in the region of high manifold depression, e.g., 14 to 18 in. Hg. there is very low EGR flow permitted; and, EGR flow reaches a substantial percentage only in the region of heavy power loading, e.g., 6 through 12 in. Hg. and drops virtually to zero at wide open throttle, e.g., 2 to 3 in. Hg. manifold depression.

Figure 2A:
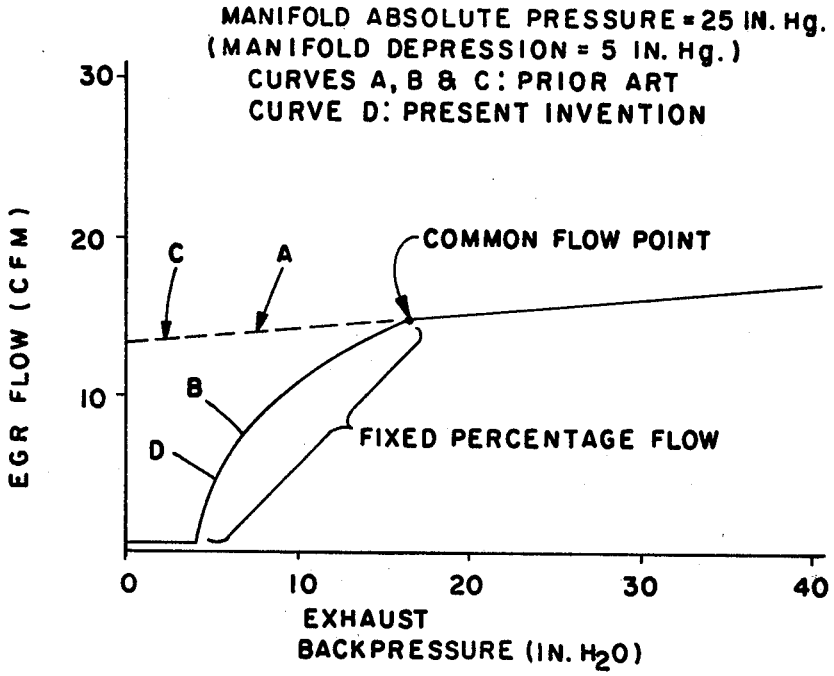
FIGS. 2(*a*) and 2(*b*) are graphs plotted of EGR flow as a function of engine exhaust backpressure for the various prior art systems and the present invention for, respectively, low and high manifold vacuum levels.
Figure 2B:
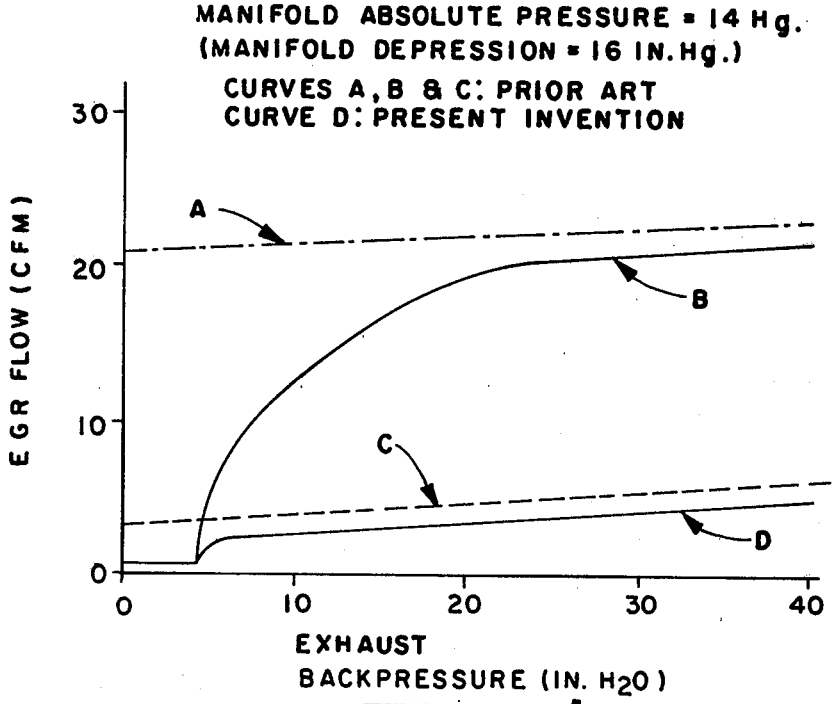

Referring now to FIGS. 2(*a*) and 2(*b*), the performance of the technique of the present invention for controlling EGR is best understood with reference to the change in the plotted curves between FIGS. 2(*a*) and 2(*b*). FIG. 2(*a*) plots EGR flow in cubic feet per minute (CFM) as a function of engine exhaust backpressure in inches of water (in. $H_2O$) for the case of heavy power loading, e.g., 5 in. Hg. manifold depression. The curves A, B, and C in FIGS (2*a*) and 2(*b*) represent the prior art systems and curve D represents the plot for the present invention. The curve labeled by letter "A" in FIGS. 2(*a*) and 2(*b*) represent the flow for a sonic EGR controller, the curve identified by the letter "B" represents an EGR controller utilizing engine backpressure for modulation, the curve identified by the letter "C" indicates EGR controlled by raw or ported manifold vacuum and curve "D" represents control employing the vacuum inverter of the present invention. The region of fixed percentage, EGR flow is identified in FIG. 2(*a*) as the region encompassing exhaust backpressures in the range of 5 through approximately 17 in. $H_2O$. Examination of FIG. 2(*a*) indicates that, at high power loading, EGR flow reaches a maximum and remains relatively constant.

Referring now to FIG 2(*b*) a graph similar to FIG. 2(*a*) has been plotted for the case of low power loading, e.g, 16 in. Hg. manifold depression where the departure of the function of the present invention from the prior art is dramatically illustrated. The curves "A" and "B" for prior art devices employing manifold vacuum and exhaust backpressure for controlling EGR are seen from FIG. 2(*b*) to provide, in order of magnitude, greater EGR flow at light power loading than the device of the present invention. Furthermore, the device of the present invention provides even less EGR flow than the prior art sonic device (curve B) which, as described hereinabove, is prohibitively complex and costly. It will be understood by those having skill in the art that additional graphs similar to FIGS. 2(*a*) and 2(*b*) could be plotted for intermediate values of manifold depression, e.g., values between 5 and 16 in. Hg., which would produce curves similarly shaped to those of FIGS. 2(*a*) and 2(*b*) for each type device, but displaced in the region intermediate the plots of FIGS. 2(*a*) and 2(*b*).

The control technique or method of the present invention employs a vacuum signal inverter for providing a control signal to a fluid pressure responsive actuator for moving an EGR valve or pintle member for controlling EGR flow in an engine to produce the desired EGR flow, which is generally a constant percentage of engine mass flow, over the range of engine power loadings where EGR is necessary to control exhaust emissions. At engine power loadings outside the desired control range, the control technique of the present invention defeats the signal to the EGR valve pintle actuators and thus provides substantially zero EGR outside the desired control range. Thus, the control technique of the present invention utilizes manifold vacuum alone as a source of power for control of EGR and permits exhaust gas to be recirculated throughout the normal operating range of engine speeds and power loadings in a manner in which the engine can accommodate the required amount of EGR for emission control. The technique of the present invention provides a control signal which cuts off EGR flow for engine operating conditions in which the engine cannot accommodate EGR flow without degradation of performance or engine faltering.

Figure 3:
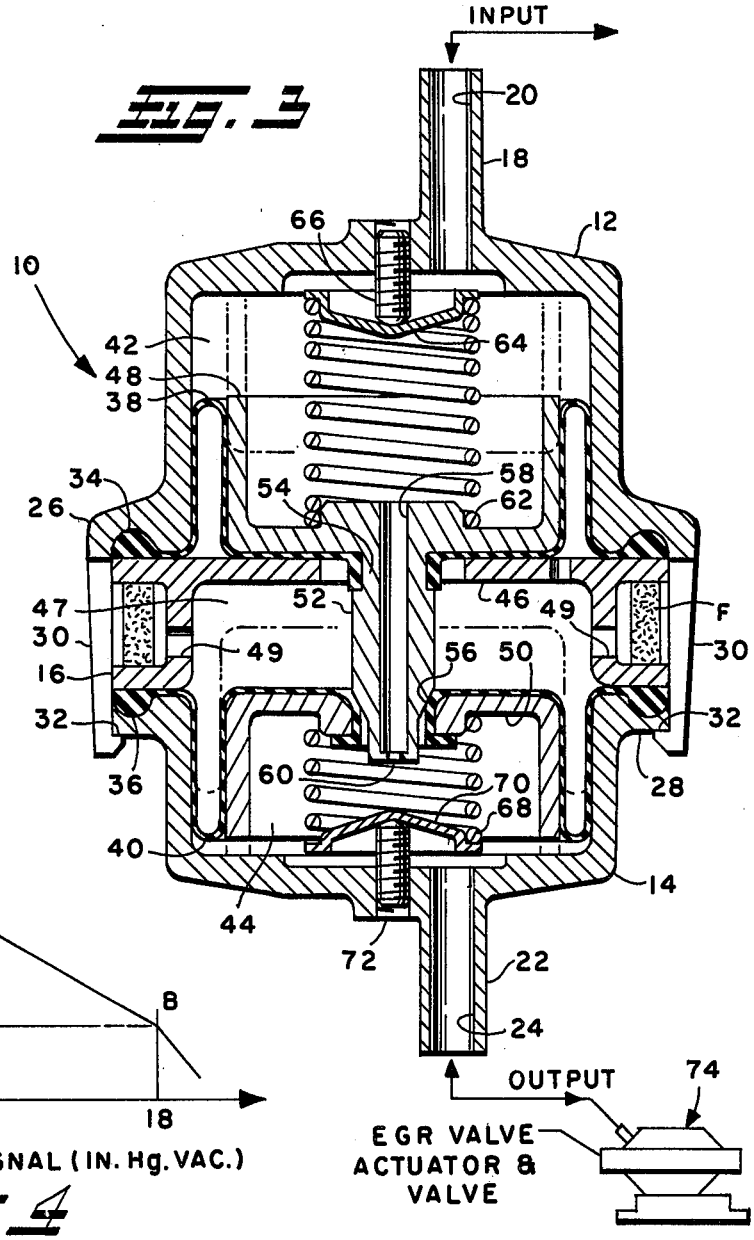
FIG. 3 is a cross-section of the vacuum inverter controller of the present invention.
Figure 4:
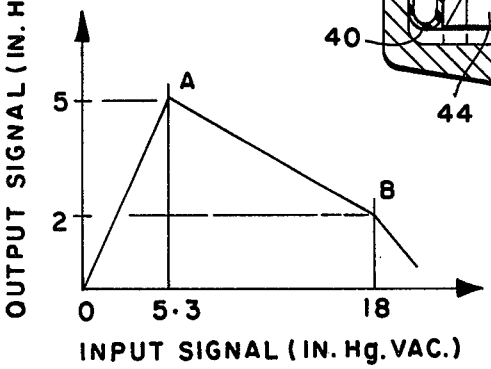
FIG. 4 is a graphical presentation of the output signal plotted as a function of the input signal for the controller of FIG. 3.
Figure 5:
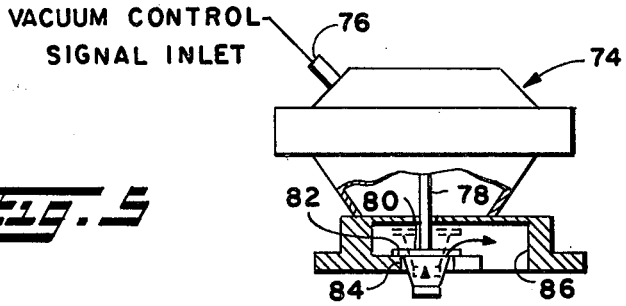
FIG. 5 is an enlarged view, partially broken away, of the EGR valve of FIG. 3.

Referring now to FIGS. 3, 4, and 5, the present invention employs a vacuum inverter 10 to receive, at its input, engine manifold vacuum; and, the inverter provides at its output a control signal which is applied to the input of an EGR valve actuator for moving the EGR control valve member to control exhaust gas recirculation within the engine. The particular function of the vacuum inverter and the exhaust valve actuator will be discussed hereinafter in greater detail.

Referring now to FIG. 3, the vacuum inverter of the present invention indicated generally at 10 is shown as having an upper housing shell 12 and a lower housing shell 14 and an intermediate spacer or middle shell 16 disposed between the upper and lower shells. The upper shell 12 has a fluid pressure signal input nipple 18 formed thereon which defines an inlet port 20 communicating with the interior of the upper housing shell. The lower shell 14 likewise has a nipple 22 provided thereon which has formed therein an outlet port 24 which communicates with the interior of shell 14 and through which passes the fluid pressure outlet signal.

The upper shell 12 has a flange 26 provided thereon adjacent the middle shell 16. Lower shell 14 has a corresponding flange 28 adjacent the middle shell 16, with flange 26 having a plurality of spaced lugs 30 disposed about the periphery thereof. Each of which lugs 30 spans the middle shell 16 having latching surfaces 32 provided thereon for locking engagement with the undersurface of flange 28 for retaining the shells 12, 14 and 16 in an assembled configuration.

Each of the flanges 26, 28 has an annular groove respectively, provided in the face of the flange adjacent the middle shell 16 and has received therein in fluid sealing relationship the bead rim portion 34, 36 of respectively upper and lower pressure responsive diaphragms 38, 40 disposed between the upper and lower shell portions and the middle shell 16. The upper diaphragm 38 forms, in cooperation with the interior of shell 12, an upper pressure chamber or cavity 42 and lower diaphragm 40 forms, in cooperation with the interior of lower shell 14, a lower or secondary pressure chamber 44. The middle shell 16 has a central hollow which forms, in cooperation with diaphragms 38 and 40 a middle chamber 47 which is vented to the atmosphere through ports 49 provided in the middle shell. In the present practice of the invention, vent ports 49 are covered by a dust filter F surrounding the middle shell. The downward movement of the primary diaphragm 38 is limited by an inwardly extending flange portion 46 extending from the middle shell 16. The vertically upward movement of the primary diaphragm 38 is limited by the upper edge of an insert cup 48 provided for diaphragm 38 and which contacts the undersurface of the upper shell 12 as indicated by the dashed lines in FIG. 3.

Similarly, downward movement of the secondary diaphragm 40 is limited by the lower edge of an insert cup 50 provided for diaphragm 40, and which rests against the inner surface of the lower shell 14 as indicated by the dashed lines in FIG. 3.

In the presently preferred practice, the housing shells and inserts are formed of plastic material, the materials being chosen for suitable service in a vehicle engine compartment environment.

The insert cup 48 for the primary diaphragm has an elongated valve member 52 attached thereto which extends downwardly through an aperture 54 formed in the central region of the diaphragm 38 with the rim of the aperture 54 formed in a lip which engages the periphery of the valve member 52 in fluid pressure sealing engagement. The valve member 52 extends downwardly and contacts an annular valve seat 56 formed in the central region of the secondary diaphragm 40 and seats therein in fluid pressure sealing contact. The valve member 52 has a bleed passage 58 formed centrally therethrough for inter-connecting primary chamber 42 and secondary chamber 44. A fluid flow restricting orifice 60 is provided at the lower end of passage 58 for restricting fluid flow between the primary chamber 42 and secondary chamber 44.

A primary bias-preload spring 62 has the lower end in contact with the primary diaphragm cup 48 and the upper end registering against a cap plate 64 which is seated on adjustment screw 66 provided through the upper housing shell 12. Spring 62 is in compression for urging the diaphragm 38 downwardly into contact with the flange 46 of the middle shell.

A secondary preload-bias spring 68 has the upper end thereof registering against the undersurface of secondary diaphragm cup 50 and the lower end of the spring registering against a guide plate 70 which is registered against an adjustment screw 72 provided through the lower housing shell 14. The spring 68 is in compression and urges the diaphragm 40 upwardly until valve seat 56 contacts the valve member 52.

In the presently preferred practice of the invention, the inverter 10 operates with a subatmospheric or vacuum signal input through port 20 and provides an output vacuum signal through port 24, with the output being inverted with respect to changes in the input signal. A typical output signal arrangement is illustrated graphically in FIG. 4 wherein for an input signal of 5.3 in. Hg. vacuum an output signal of 5 in. Hg vacuum is provided; and, upon the input signal increasing to 18 in. Hg. vacuum the output signal decreases to 2 in. Hg. vacuum.

The preload setting of the secondary spring 68 is chosen such that, when chamber 44 is not sufficiently deadheaded by connection through output port 24 to the auxiliary mechanism to be controlled such that a sufficient vacuum can form in chamber 44 to open the bleed valve, valve seat 56 is maintained in contact with the valve member 52 by spring 68 and diaphragm 38 follows the motion of valve member 52.

In operation, the controller inverter of FIG. 10 is typically connected to an input source of vacuum, as for example, engine manifold vacuum either raw or ported, and the output is connected to a fluid pressure actuated device to be controlled, as for example, in exhaust gas recirculation (EGR) valve 74 as shown in FIG. 3. However, it will be understood that any fluid pressure actuated device may be controlled by the inverter controller 10 of FIG. 3 wherein it is desired that the vacuum signal to the device to be controlled vary inversely as changes in the input signal.

The operation of the inverter controller 10 will now be described in detail with reference to FIGS. 3 and 4 wherein the input signal vacuum is applied through port 20 to chamber 42 and through passage 58 and orifice 60 also applied to chamber 44. If the output port 24 is connected to a device such that no air bleed is permitted to chamber 44 through the device to be controlled, chambers 42 and 44 both reach a common vacuum level and the vacuum level in both chambers increases at the same rate, as for example, from 0 to A with reference fo FIG. 4.

At a predetermined signal level, such as the level of point A in FIG. 4, with middle chamber 47 vented to the atmosphere through ports 49, the force generated by the vacuum in chambers 42 and 44 acting across diaphragms 38 and 40 respectively balance the preloads of each of springs 62 and 68. As the input signal level increases further, as for example, to point B as shown in FIG. 4, the force of pressure differential due to the vacuum in chamber 42 acting across diaphragm 38 overcomes the preload on spring 62 and diaphragm 38 tends to move in an upward direction pulling valve member 52 with it. Simultaneously, the force acting on diaphragm 40, due to the differential pressure caused by the vacuum in chamber 44, tends to move diaphragm 40 in a downward direction causing valve seat 56 to move away from contact with valve member 52.

As the valve sealing contact on seat surface 56 is broken, vent flow from chamber 47 occurs through the bleed valve to chamber 44. This causes loss of vacuum in chamber 44. However, restricting orifice 60 in the end of valve member 52 prevents sudden loss of vacuum in chamber 42 since flow from chamber 44 thereto is restricted by the orifice 60. Thus, the vacuum in chamber 42, remains at a higher level than the vacuum in chamber 44 and valve member 52 remains in an upwardly moved position from its initial at rest position, and spring 68 urges diaphragm 40 in an upward direction tending to reseal the valve seat 56 against the valve member 52.

As the spring 68 extends, a reduced load is thus required to move the diaphragm 40 downwardly again; and, thus, a lower signal level, or lesser vacuum is required in chamber 44 to reestablish the force balance between diaphragm 38 and spring 68.

If the input signal to chamber 48 remains unchanged with spring 68 in the new position and the pressure in chamber 44 is equalized through orifice 60, any upward movement of diaphragm 40 increases the vacuum level in chamber 42 by restricting the vent flow through valve seat 56 which in turn increases the force acting on the diaphragm and tends to return diaphragm 40 to its equilibrium position with respect to spring 68. Conversely, if diaphragm 40 moves downward, vent flow across valve seat 56 is increased causing loss of vacuum in chamber 44 and spring 68 returns the diaphragm 40 to its equilibrium position again. Thus, as the input signal increases further (higher vacuum) the output signal continues to fall (lower vacuum) as for example, from point A to point B with reference to FIG. 4.

When the output signal has reached a predetermined level, as for example, point B in FIG. 4, diaphragm 40 is restrained from further movement by contact with the lower surface of flange 46 and further increases an input signal (higher vacuum) caused the valve member 52 to be pulled away from diaphragm seat 56 thereby permitting the chamber 44 to be fully vented and complete loss of vacuum occurs, and the output signal thus tends to 0.

As input signal decreases (decreased vacuum) spring 62 moves diaphragm 38 downward to cause valve member 52 to reduce the vent area across valve seat 56 thereby causing the vacuum in chamber 44 to increase and tends to compress spring 68. Diaphragm 40 will therefore begin to move downward from its position against the stop producing a higher output signal when equilibrium is reestablished. As the input signal is further decreased (lower vacuum) the output signal increases, as for example, moving from point B to point A on the graph of FIG. 4. When a higher output signal level has been achieved, as for example, point A on the graph of FIG. 4, diaphragm 38 once again reaches its stop resting against flange 46, whereupon the valve seat 56 seals against the valve member 52 and further control is defeated.

As shown in FIGS. 3 and 5, the output signal from port 24 is applied to vacuum inlet nipple 76 of an EGR valve 74. Valve 74 has a pressure responsive mechanism therein (not shown) which functions to move rod 78 attached to valve member or pintle 80 shown in closed position in solid line in FIG. 5 and in the open position in dashed line. When the signal applied to inlet 76 is sufficient to raise pintle 80 from its seat 82 it causes engine exhaust gas to flow from passage 84, convected to the engine exhaust, to passage 86, convected to the engine combustion chamber inlet.

From the foregoing description it will be apparent that the inverter controller 10 of the present invention provides inversion of changes in a vacuum signal upon the vacuum reaching a predetermined level below which no inversion is provided; and, again, when the input vacuum signal reaches a second predetermined level no output signal is provided. Thus, the inverter controller of the present invention when connected to a variable vacuum source such as engine manifold vacuum provides an output signal which is inverted with respect to changes in the input signal, for a desired range of input signals, and provides no output when the input signal is outside the desired range.

The present invention thus provides a unique and novel way of utilizing engine manifold vacuum to control EGR at a generally constant percentage of engine mass flow over the desired range of load, and defeat or limit EGR flow for engine operating conditions outside the desired load range. The unique control of EGR is provided by a vacuum inverter insertable in the vacuum supply line from the engine intake manifold to the fluid pressure actuated EGR valve.

Although the invention has been hereinabove described in the preferred form, it will be apparent to those skilled in the art that modifications and variations may be readily made without departing from the invention which is limited only by the following claims.

We claim:

1. A fluid pressure signal inverting controller comprising:

(a) housing means defining a fluid pressure signal input and a fluid pressure signal output port and an atmospheric vent port;

(b) primary fluid pressure responsive means (PRM) disposed within said housing means and defining in cooperation therewith a primary fluid pressure chamber communicating with said input port;

(c) first spring means operative to provide a predetermined preload and bias on said primary PRM in one direction such that said primary PRM moves in response to the pressure differential thereacross to seek an equilibrium position with said first spring means;

(d) valve means associated with said primary PRM and movable therewith, said valve means defining a fluid pressure bleed passage communicating with said primary chamber;

(e) secondary PRM disposed within said housing means and defining in cooperating therewith a seondary fluid pressure chamber communicating with said output port and said bleed passage, said primary and secondary PRM being disposed so as to define therebetween an atmospheric chamber communicating with said vent port, said secondary PRM including means defining a valve seat cooperating with said valve means to provide communication between said secondary pressure chamber and said vent chamber;

(f) second spring means operative to provide a predetermined preload and bias on said secondary PRM such that in response to the pressure differential between said secondary chamber and said atmospheric chambers acting thereon said secondary PRM seeks an equilibrium position with said secondary spring means thereby determining the position of said valve seat with respect to said valve means for controlling fluid communication between said chamber and said atmospheric chamber.

2. The device defined in claim 1, wherein said valve seat comprises an annular surface and said valve means includes a member extending axially through said annular seat with said bleed passage formed through said member.

3. The device defined in claim 1, wherein said first and second spring means includes means for adjusting the preload.

4. The device defined in claim 1, wherein said housing means includes an upper shell housing having a nipple thereon defining said input port and a lower shell having a nipple thereon defining said output port; said primary PRM sealing about the periphery of said upper shell for forming said primary chamber and said secondary PRM sealing about the periphery of said lower shell for forming said secondary chamber.

5. The device defined in claim 1, wherein (a) said housing means includes an upper shell housing having a nipple thereon defining said output port, said primary PRM sealing about the periphery of said upper shell for forming said primary chamber and said secondary PRM sealing about the periphery of said lower shell for forming said secondary chamber; and (b) said housing means includes a middle shell means disposed intermediate said upper and lower shell means, said middle shell means including means defining said atmospheric vent port.

6. The device defined in claim 1, wherein said housing means includes an upper shell and a lower shell, said upper shell having said primary PRM sealing about the periphery thereof for forming said primary chamber, said lower shell having said secondary PRM sealing about the periphery for forming said secondary chamber, said housing means including means snap-locking said upper shell with said lower shell.

7. The device defined in claim 1, wherein said housing means includes:

(a) an upper shell means defining in cooperation with said primary PRM said primary chamber and a lower shell means defining in cooperation with said secondary PRM said secondary chamber and middle shell means disposed intermediate said upper shell and said lower shell; and, (b) means joining in snap-locking engagement with said upper and lower shell means in contact with said middle shell means.

8. A fluid pressure signal inverting controller comprising:

(a) housing means defining a cavity and including means defining a fluid pressure signal input port, a fluid pressure signal output port and an atmospheric vent port communicating with said cavity;

(b) pressure responsive means (PRM) disposed within said housing means, said PRM being movable with respect to said housing means to provide a controlled output signal in response to application of a variable fluid pressure signal to said input port;

(c) bleed means operative to control bleed flow through said vent port and operative in response to a given change in said input signal to provide proportionately inverse changes in said output signal.

9. The device defined in claim 8, wherein:

(a) said PRM comprises a pair of spaced diaphragms defining a vent chamber therebetween.

10. The device defined in claim 8, wherein:

(a) said PRM comprises a pair of spaced diaphragms defining, in cooperation with said housing means, a primary pressure chamber communicating with said input port and a secondary chamber communicating with said output port;

(b) said bleed means includes:

(i) a bleed passage communicating said primary chamber with said secondary chamber, and (ii) valve means operative to control flow between said vent port and said secondary chamber.

11. The device defined in claim 8, wherein said controller is inoperative to control said output signal for input signals less than a predetermined input signal level applied to said input port.

12. A fluid pressure signal controller comprising:

(a) housing means defining a cavity and including means defining an input port to said cavity adapted for connection to a variable source of fluid pressure, means defining a fluid pressure signal output port communicating with said cavity and adapted for connection to a device to be controlled, means defining an atmospheric vent port communicating with said cavity;

(b) pressure responsive means (PRM) disposed in said housing means, said pressure responsive means including a member movable with respect to said housing means and operative upon application of a predetermined level of fluid pressure to said input port to control flow through said vent port and for given input pressure signal levels greater than said predetermined level, said pressure responsive means is operative to provide a proportionate inverse change in said output signal.

13. A method of operating an internal combustion engine comprising the steps of:

(a) providing an exhaust gas recirculation (EGR) passage connecting the combustion chamber exhaust outlet with the combustion chamber inlet;

(b) providing a movable valve member in said EGR passage for controlling EGR flow;

(c) sensing and inverting changes in engine inlet induction pressure to provide a fluid pressure source that changes inversely with changes in said inlet induction pressure and moving said valve member in response to said source such that, for a given range of levels of inlet induction pressure, EGR flow is maintained as a substantially constant percentage of engine mass flow at such levels and at levels less than said range, and greater than said range, EGR flow is limited to a desired maximum flow rate.

14. The method defined in claim 13 wherein said step of moving said valve member includes applying said fluid pressure source to a fluid pressure responsive actuator for moving said valve member.

15. The method defined in claim 13, wherein the step of moving said valve member further comprises applying said fluid pressure source to fluid pressure actuator and modulating said actuator in response to changes in combustion chamber exhaust outlet pressure.

16. In combination with an internal combustion engine having a combustion chamber inlet induction passage and a combustion chamber exhaust discharge passage, movable valve means for providing exhaust gas recirculation (EGR) from said discharge passage to said induction passage, means for sensing fluid pressure changes in said induction passage operative for inverting said changes to provide a source of fluid pressure which changes inversely with changes in induction passage pressure, fluid pressure responsive actuator means receiving said source of fluid pressure and operative for moving said valve means in response to changes in said fluid pressure source, said movement being controlled such that EGR flow is provided as a substantially constant percentage of engine air mass flow over a predetermined range of inlet induction pressures and EGR flow is substantially defeated at inlet induction passage pressures outside said range.

17. The combination defined in claim 16 further comprising means operative to modulate movement of said valve means with changes in engine exhaust discharge pressure.

* * * * *